US006615850B1

(12) United States Patent
Hornung

(10) Patent No.: US 6,615,850 B1
(45) Date of Patent: Sep. 9, 2003

(54) DISHWASHER SANITATION CYCLE

(75) Inventor: Richard Edward Hornung, Fisherville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/659,113

(22) Filed: Sep. 11, 2000

Related U.S. Application Data

(60) Provisional application No. 60/153,408, filed on Sep. 10, 1999.

(51) Int. Cl.[7] ..... B08B 3/02
(52) U.S. Cl. ..... 134/57 R; 134/57 D; 134/108
(58) Field of Search ..... 134/56 R, 57 R, 134/58 D, 18, 105, 108

(56) References Cited

U.S. PATENT DOCUMENTS

| | | | | |
|---|---|---|---|---|
| 3,049,133 | A | | 8/1962 | Jacobs |
| 3,575,157 | A | * | 4/1971 | Whittel, Jr. |
| 3,903,909 | A | | 9/1975 | Noren et al. |
| 4,334,143 | A | | 6/1982 | Cushing |
| 4,439,242 | A | | 3/1984 | Hadden |
| 4,509,543 | A | * | 4/1985 | Livingston et al. |
| 4,689,089 | A | | 8/1987 | Eberhardt, Jr. et al. |
| 5,462,606 | A | | 10/1995 | Burns |
| 5,560,060 | A | | 10/1996 | Dausch et al. |
| 5,669,983 | A | * | 9/1997 | Cooper et al. |
| 5,679,173 | A | * | 10/1997 | Hartman |
| 5,797,409 | A | * | 8/1998 | Cooper et al. |
| 5,889,244 | A | | 3/1999 | Kraus |
| 6,432,216 | B1 | * | 8/2002 | Thies |

FOREIGN PATENT DOCUMENTS

| | | | |
|---|---|---|---|
| DE | 3403300 | * | 8/1985 |
| GB | 2250678 | * | 6/1992 |
| JP | 5-91966 | * | 4/1993 |
| JP | 9-135802 | * | 5/1997 |
| JP | 11-276411 | * | 10/1999 |
| JP | 2000-279360 | * | 10/2000 |

* cited by examiner

*Primary Examiner*—Frankie L. Stinson
(74) *Attorney, Agent, or Firm*—George L. Rideout, Jr.; Armstrong Teasdale, LLP

(57) ABSTRACT

A dishwasher sanitation cycle includes sampling a temperature of rinse water inside a dishwasher, executing a heating cycle to keep water temperature at optimal levels, and executing a heat sum cycle to ensure that dishes are sanitized according to accepted standards.

11 Claims, 2 Drawing Sheets

DISHWASHER SANITATION CYCLE

CROSS REFERENCE TO RELATED APPLICATIONS

This application claims the benefit of U.S. Provisional Application No. 60/153,408, filed Sep. 10, 1999.

BACKGROUND OF THE INVENTION

This invention relates generally to dishwashers and, more particularly, to dishwashers having a sanitation cycle feature.

A dishwashing machine typically includes a water pump, spinning water jets, and a controller for executing a number of different wash cycles according to user preference, such as that disclosed in U.S. Pat. No. 4,334,143. The cleaning efficacy achieved by domestic spray-type dishwashing machines in executing those wash cycles, however, is generally determined by the manufacturer's of the machines. A public interest group known as the National Sanitation Foundation (N.S.F.) has promulgated minimum voluntary standards that have generally been accepted by dishwasher manufacturers, and that are increasingly desired by consumers. The current N.S.F. protocol (Protocol No. 95/480/05/2480) for the performance of domestic spray-type dishwashers requires that a dishwasher sanitation cycle has a time, temperature relationship that exposes dishwasher contents to a minimum amount of heat, measured in theoretical Heat Unit Equivalents (HUE).

However, the theoretical HUE construct is not always physically realized due to fluctuations in dishwasher system conditions, such as water temperature, during all or a portion of a dishwasher cycle. If water temperature drops, the dishwasher contents may not be sufficiently sanitized. If water temperature rises, dishes may be over-sanitized, which is energy inefficient. Consequently, the accuracy and energy efficiency of dishwasher sanitation cycles are often suspect.

Accordingly, it would be desirable to provide a dishwasher with an accurate sanitation cycle that minimizes the time and energy required to complete a desired degree of sanitization.

BRIEF SUMMARY OF THE INVENTION

In an exemplary embodiment of the invention, a method for sanitizing the contents of a dishwasher including a rinse water temperature sensor, a rinse water heater, and a controller coupled to the sensor and to the water heater, includes determining the temperature of the rinse water at fixed time intervals with the sensor. The sensed temperature is supplied to the controller, which compares the determined temperature of the rinse water to a minimum sanitation cycle temperature, a low sanitation cycle temperature, and a high sanitation cycle temperature.

The minimum sanitation cycle temperature is the lowest temperature recognized by N.S.F. that has a tabulated HUE value. For each timer interval when the determined temperature is at least the minimum sanitation cycle temperature, an HUE value corresponding to the determined temperature is indexed from a memory of the controller. HUEs are cumulatively summed at successive intervals while the determined temperature equals or exceeds the minimum sanitation cycle temperature. The process is repeated with each successive time interval until the summed HUE total equals or exceeds a minimum value according to N.S.F. protocol.

The low and high sanitation cycle temperatures are used to execute a heating cycle for each time interval in response to the determined temperature. The low sanitation cycle temperature is predetermined to minimize sanitation cycle time while avoiding excessive hysteresis, i.e. cycling of the heater. The high sanitation cycle temperature is determined by the crazing of glassware and dishware placed in the dishwasher. When the determined temperature is less than the low sanitation cycle temperature, the water heater is turned on. When the determined temperature is greater than a high sanitation cycle temperature, the water heater is turned off. Thus, water temperature is optimized to minimize cycle time at energy-saving temperatures.

Thus, an accurate dishwasher sanitation cycle is provided that conserves energy and the required time to complete a sanitation cycle while ensuring that a minimum level of sanitation is achieved.

DETAILED DESCRIPTION OF THE INVENTION

Figure 1:
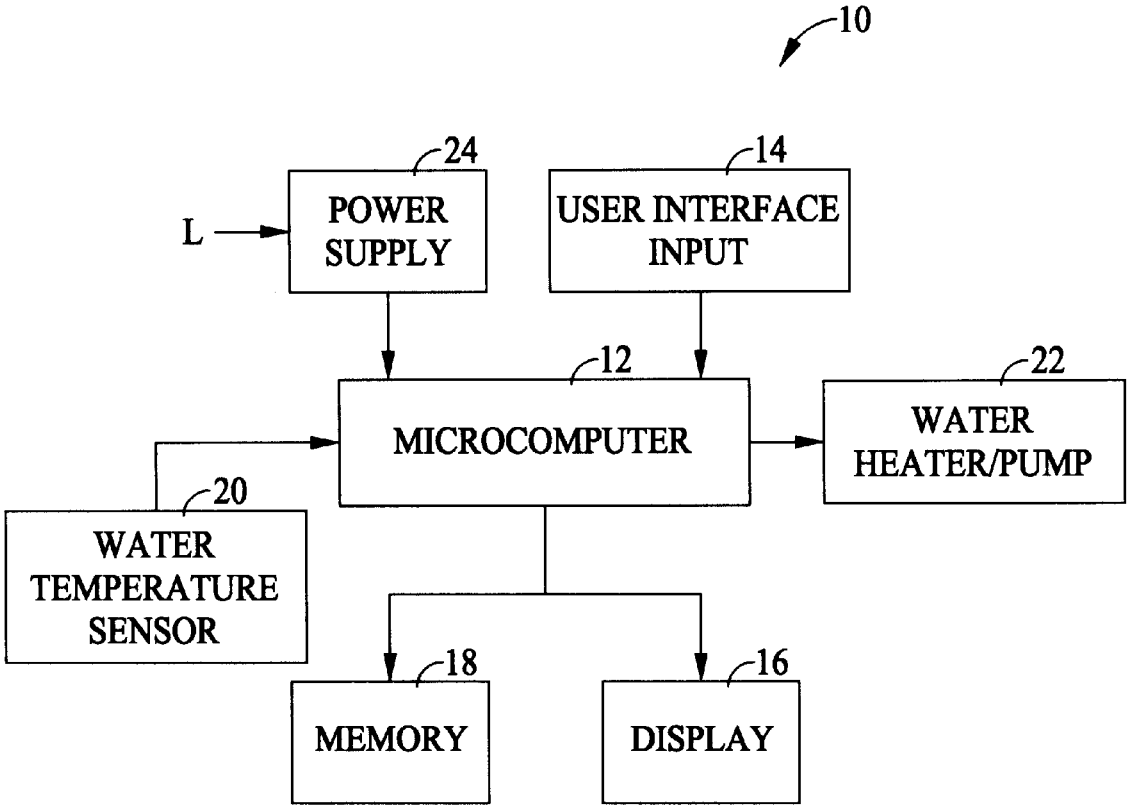
FIG. 1 is a block diagram of a dishwasher control system.

FIG. 1 is a block diagram of a dishwasher control system 10 including a controller 12 which may, for example, be a microcomputer coupled to a dishwasher user interface input 14. An operator may enter instructions or select desired dishwasher cycles and features to be performed via user interface input 14, and a display 16 coupled to controller 12 displays appropriate messages, indicators, a timer, and other known items of interest to dishwasher users. A memory 18 is also coupled to microcomputer controller 12 and stores instructions, calibration constants, and other information as required to satisfactorily complete a selected dishwasher cycle. Memory 18 may, for example, be a random access memory (RAM). In alternative embodiments, other forms of memory could be used in conjunction with RAM memory, including but not limited to electronically erasable programmable read only memory (EEPROM).

Controller 12 is also coupled to a water temperature sensor 20, which is inputted to controller and for operating a water heater/pump 22 in response thereto as described in detail below. Analog to digital and digital to analog convertors (not shown) are coupled to controller 12 to implement the controller input from water temperature sensor 20 and the controller output to water pump/heater 22 according to known methods. Power is supplied to controller 12 by a power supply 24 configured to be coupled to a power line L. Of course, controller 12 may be used to control other dishwasher elements and functions beyond that specifically described herein.

In response to manipulation of user interface input 14, controller 12 monitors various operational factors of the dishwasher, and executes operator selected functions and features according to known methods. Temperature sensor 20 is thermally coupled with water exiting the water pump to sense the temperature of the water in a dishwasher tub (not shown) and is located, for example, in a bottom of the tub, in fluid communication with the water stream discharged from a water pump inside the dishwasher, or mounted to a pipe to sense the water temperature before it exits the water pump. The construction and operation of temperature sensors are well known.

A signal from temperature sensor 20 is supplied to controller 12 for regulating the internal temperature of the dishwasher by processing the temperature signal from temperature sensor 20. Controller 12 adjusts the sensed temperature, if necessary, by an empirically determined amount to compensate for temperature differences of the water at the sensed location and the theoretical test plate temperature according to N.S.F. protocol. In other words, controller 12 adjusts the sensed temperature to compensate for temperature offset at the sensed location relative to a specific position inside the wash tub that N.S.F. has selected as a reference point. A table of empirically determined temperature offsets is stored in 18 memory of controller 12. Controller 12 indexes a temperature offset from the table based on the sensed temperature and adjusts the sensed temperature accordingly to ensure that a minimum level of sanitation is achieved.

Figure 2:
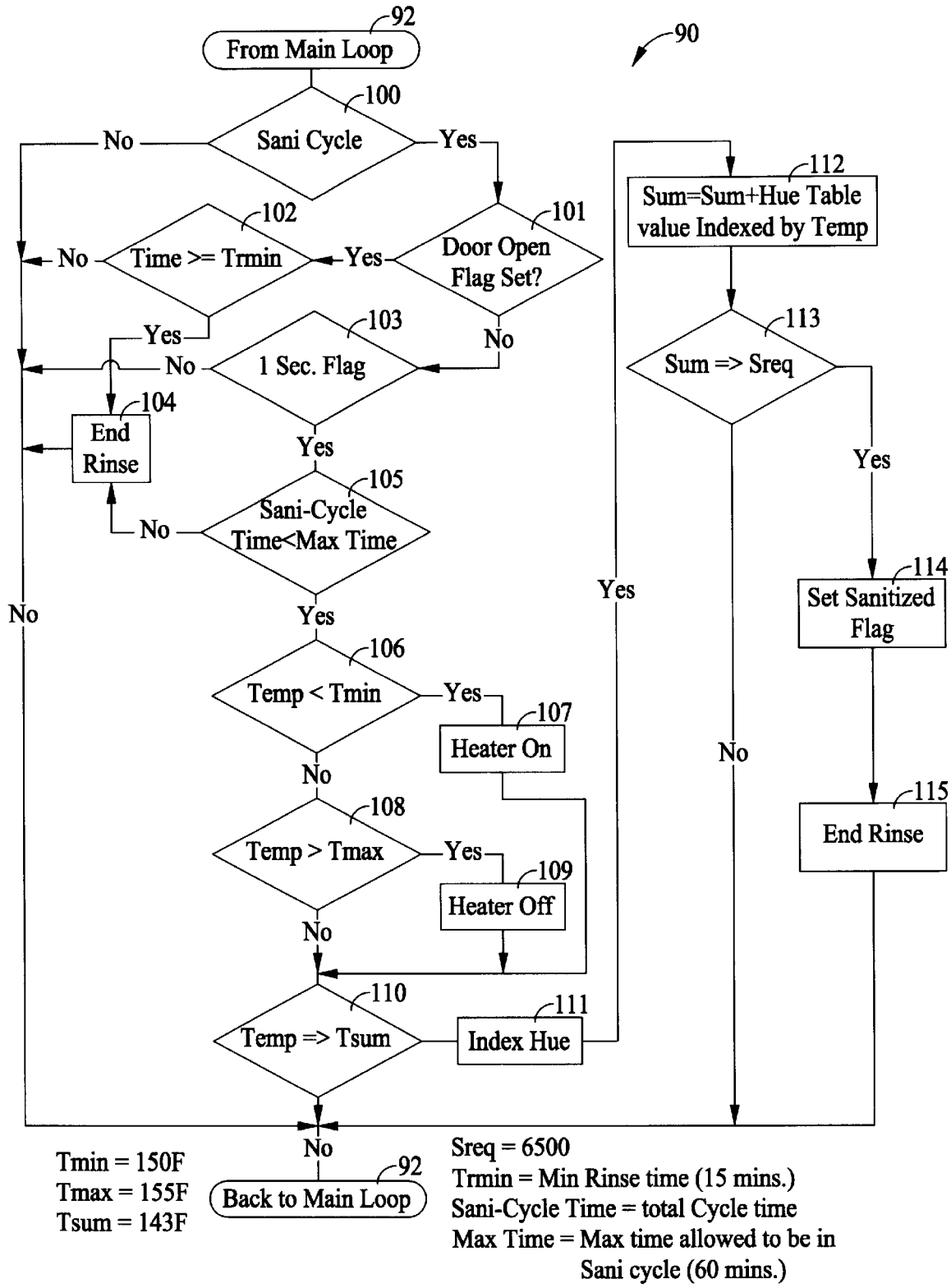
FIG. 2 is a flow chart of a dishwasher sanitation cycle.

FIG. 2 is a flow chart of a dishwasher sanitation cycle 90 for a dishwasher (not shown in FIG. 2) including a wash tub (not shown in FIG. 2), a water pump (not shown in FIG. 2), a water heater (not shown in FIG. 2), all in accordance with known dishwashers, and controller 12 (shown in FIG. 1). A sanitation cycle loop 90 is executed by controller 12 at an appropriate point in a controller main loop 92 during the wash cycle. First, controller 12 confirms 100 whether a sanitation cycle rinse is enabled, i.e., whether a user has selected the sanitation cycle to be performed by manipulating user interface input (shown in FIG. 1). If the sanitation cycle is not selected, the remainder of sanitation cycle loop 90 is by-passed by controller 12 and controller 12 returns to main loop 92.

If the sanitation cycle has been selected, controller 12 confirms 101 that a dishwasher door is closed. If the door is opened, controller 12 compares 102 an elapsed time with a minimum rinse time, and either ends 104 the rinse when elapsed time exceeds the minimum rinse time, or reverts back to the main control loop 92 when elapsed time is less than the minimum rinse time.

When the dishwasher door is closed, controller 12 executes a one second flag and executes the following routine at one second intervals. Controller 12 compares 105 an elapsed sanitation cycle time with a maximum allowable sanitation cycle time. If elapsed sanitation cycle time is greater than or equal to the maximum allowable sanitation cycle time, then controller 12 ends 104 the sanitizing rinse, sanitation cycle loop 92 is exited and controller 12 returns to main loop 92 without setting the sanitized flag. Thus, sanitation cycle loop 90 will terminate automatically upon the expiration of a preset maximum allowable sanitation time. In a particular embodiment, for example, the maximum allowable sanitation cycle time is 60 minutes.

If the elapsed sanitation cycle time is less than the maximum allowable time, controller 12 samples the rinse water temperature at each 1 second interval and, depending on the position of the sensor, adjusts the sensed temperature by a temperature offset stored in controller memory 18 (shown in FIG. 1) so that actual sanitization will correspond to N.S.F. protocol.

Once the adjusted water temperature is determined, a heating cycle is executed based on the determined temperature. Heating cycle includes controller 12 comparing 106 the determined temperature with a low sanitation cycle temperature, and comparing 108 the determined sanitation cycle temperature with a high sanitation cycle temperature. If the determined temperature is below the low sanitation cycle temperature, heating cycle commences by the controller 12 turning on 107 the water heater. If the determined temperature is above the high cycle temperature, heating cycle concludes by controller 12 turning off 109 the water heater.

If the determined temperature is greater than the applicable protocol minimum temperature, i.e., the lowest temperature recognized by N.S.F. that has a tabulated HUE value, a heat sum cycle begins by comparing 110 the determined temperature with the sanitation cycle minimum temperature. In a particular embodiment, the minimum sanitation cycle temperature is 143 F. (the lowest temperature recognized by N.S.F. as having a Heating Equivalent Unit (HUE)), the low sanitation cycle temperature is 150 F., and the high sanitation cycle temperature is 155 F. The high and low sanitation cycle temperatures are selected to minimize sanitation cycle time while protecting the glassware and dishware placed in the dishwasher, and while obtaining an acceptable performance and life span of the water heater components. More specifically, the low sanitation cycle temperature is predetermined to minimize sanitation cycle time while avoiding excessive hysteresis, i.e. excessive cycling of a sequence switch (not shown) to turn the heater on and off and to maintain the water temperature between the high and low temperatures. The high sanitation cycle temperature is determined by the crazing of glassware and dishware used in the dishwasher. Of course, different temperature settings could be chosen for the low and high sanitation cycle temperatures to achieve different performance goals.

If the determined temperature is less than the sanitation cycle minimum temperature, controller 12 exits sanitation loop 90 and returns to main loop 92. If the determined temperature equals or exceeds the minimum sanitation cycle temperature, controller 12 begins indexing 111 an HUE value corresponding to the determined temperature from a table of HUE values and determined temperatures stored in the controller memory. Temperatures and HUE values are provided by is N.S.F. After indexing 111 the HUE value for a particular time interval, controller 12 cumulatively sums 112 the HUE with HUE values from previous intervals in the sanitation cycle.

For example, the following table illustrates the operation of the heat sum cycle using the HUE values of NSF Protocol No. 95/480/05/2480:

| Time | Water Temp. (° F.) | HUE | HUE SUM |
|---|---|---|---|
| t0 | 142.9 | 0.0 | 0.0 |
| t1 | 143.0 | 1.0 | 1.0 |
| t2 | 143.0 | 1.0 | 2.0 |
| t3 | 143.0 | 1.0 | 3.0 |
| t4 | 143.1 | 1.0 | 4.0 |
| . | . | . | . |
| . | . | . | . |
| . | . | . | . |
| t200 | . | . | 250.0 |
| t201 | 144.0 | 1.3 | 251.3 |
| t203 | 144.1 | 1.3 | 252.6 |
| . | . | . | . |
| . | . | . | . |
| . | . | . | . |
| t500 | . | . | 700.0 |
| t501 | 152.0 | 11.0 | 711.0 |

Heat sum cycle also includes comparing 112 the cumulatively summed HUE value for the sanitation cycle with a desired HUE summed total. While N.S.F. Protocol No. 95/480/05/2480 domestic spray-type dishwashers require a minimum total cumulative HUE value of 2700 units, a higher HUE value may be selected by a user, or be selected as a default by controller 12.

In a particular embodiment, a default HUE value for comparison 112 is automatically selected by controller 12, such as, for example, 6500. In a further particular embodiment, a user may select another value instead of the default value.

If the cumulatively summed HUE value is less than the selected minimum value, the sanitation cycle loop 90 restarts and water rinse temperatures are sampled at 1 second intervals, generating a new cumulatively summed HUE value at each interval. If the cumulatively summed HUE value is greater than or equal to the selected minimum value, a sanitized flag is set 113 and the sanitizing rinse is ended 114. Controller 12 then reverts back to main loop 92 for completing the washer cycle. In an exemplary embodiment, sanitation cycle loop is completed in about 25 minutes, and the overall wash cycle time is about 55 minutes.

Thus, due to close monitoring of the rinse water temperature and water heater adjustments in response thereto, the above-described dishwasher sanitation cycle achieves a specified level of sanitation accurately, consistently and efficiently, despite fluctuations in dishwasher system characteristics. The sanitation cycle is also easily adaptable to future N.S.F. standards or other applicable standards by loading the applicable data into controller memory 18.

While the invention has been described in terms of various specific embodiments, those skilled in the art will recognize that the invention can be practiced with modification within the spirit and scope of the claims.

What is claimed is:

1. A method for sanitizing contents of a dishwasher with rinse water, the dishwasher including a rinse water temperature sensor and a rinse water heater and a controller coupled to the sensor and the heater, said method comprising the steps of:

executing a temperature cycle to determine rinse water temperature;

executing a heating cycle to optimize rinse water temperature;

indexing a heat sum value for the determined rinse water temperature;

executing a heat sum cycle to monitor heating of the dishwasher contents; and repeating the above steps at fixed time intervals until a predetermined heat sum value is obtained.

2. A method in accordance with claim 1 wherein said step of executing a temperature cycle comprises the steps of:

sensing the temperature of the rinse water;

comparing the temperature of the rinse water at each interval to a minimum sanitation cycle temperature, a low sanitation cycle temperature, and a high sanitation cycle temperature.

3. A method in accordance with claim 2 wherein said step of executing a temperature cycle further comprises calculating an adjusted rinse water temperature to account for heat loss between the temperature sensor and the position of dishwasher contents.

4. A method in accordance with claim 2 wherein said step of executing the heating cycle comprises the steps of:

turning on the rinse water heater when the determined temperature is below the sanitation cycle low temperature; and turning off the rinse water heater when the determined temperature is above the sanitation cycle high temperature.

5. A method in accordance with claim 2 wherein said step of indexing a heat sum value for the determined rinse water temperature comprises the steps of:

referencing a heat unit equivalent for the determined rinse water temperature from heat unit equivalent values stored in a controller memory; and storing the referenced heat unit equivalent.

6. A method in accordance with claim 1 wherein said step of executing a heat sum cycle comprises the step of adding the heat sum value at each cycle to the cumulative heat sum cycle from previous fixed time intervals.

7. A method in accordance with claim 1 wherein the fixed time interval is one second.

8. A controller for a dishwasher including a water temperature sensor, a water heater, and a water pump, said controller programmed to:

monitor a rinse water temperature at a fixed time interval and operate the water heater and water pump in response thereto when a dishwasher sanitation cycle is selected;

index a heat unit equivalent value at the fixed time interval when said rinse water temperature is within an acceptable sanitization range; and cumulatively sum a heat unit equivalent total at each successive fixed time interval until a selected cumulative sum is reached.

9. A controller in accordance with claim 8 wherein monitoring the rinse water temperature comprises:

comparing a sensed water temperature to a low sanitation cycle temperature; and energizing the water heater if the sensed temperature is below the minimum temperature.

10. A controller in accordance with claim 8 wherein monitoring the rinse water temperature comprises:

comparing a sensed water temperature to a high sanitation cycle temperature; and de-energizing the water heater if the sensed temperature is below the minimum temperature.

11. A controller in accordance with claim 8 wherein monitoring the rinse water temperature comprises:

sensing a rinse water temperature; and determining an adjusted rinse water temperature to account for heat loss between the temperature sensor and the position of dishwasher contents.

* * * * *